United States Patent [19]

Olivieri

[11] Patent Number: 4,937,952

[45] Date of Patent: Jul. 3, 1990

[54] FASTENING ARRANGEMENT FOR REAR ENTRY TYPE SKI BOOTS

[75] Inventor: Oliviero Olivieri, Montebelluna, Italy

[73] Assignees: Icaro Olivieri; C.S.p.A. Minuterie Metalliche, both of Treviso, Italy

[21] Appl. No.: 364,041

[22] Filed: Jun. 9, 1989

[30] Foreign Application Priority Data

Jun. 22, 1988 [IT] Italy ..... 21475/88[U]

[51] Int. Cl.[5] ..... A43B 5/04

[52] U.S. Cl. ..... 36/119; 36/50; 36/117

[58] Field of Search ..... 36/117–121, 36/50; 24/140

[56] References Cited

U.S. PATENT DOCUMENTS

| | | | |
|---|---|---|---|
| 4,281,468 | 8/1981 | Giese et al. | 36/121 |
| 4,408,403 | 10/1983 | Martin | 36/117 X |
| 4,669,201 | 6/1987 | Pozzobon | 36/117 |
| 4,711,042 | 12/1987 | Morell et al. | 36/50 |
| 4,769,929 | 9/1988 | Sartor | 36/117 |
| 4,793,077 | 12/1988 | Walkhoff et al. | 36/117 |

FOREIGN PATENT DOCUMENTS

| | | | |
|---|---|---|---|
| 1325825 | 3/1963 | France | 36/50 |
| 1390882 | 1/1965 | France | 36/117 |
| 2399811 | 3/1979 | France | 36/119 |

*Primary Examiner*—Paul T. Sewell
*Assistant Examiner*—Andrew D. Meyers
*Attorney, Agent, or Firm*—Sughrue, Mion, Zinn, Macpeak & Seas

[57] ABSTRACT

To exert a balanced and symmetrical pull on the bootleg of a ski boot, a boot fastening cable is run over a plurality of lay pulleys arranged at symmetrical locations on the ski boot and over a guide on a rear mounted lever with the ends of the cable secured to opposite sides of the ski boot.

3 Claims, 2 Drawing Sheets

FASTENING ARRANGEMENT FOR REAR ENTRY TYPE SKI BOOTS

BACKGROUND OF THE INVENTION

This invention relates to a fastening arrangement for ski boots, particularly but not exclusively intended for ski boots of the so-called rear-fit type, wherein a front part and rear part jointly define the bootleg of the ski boot and are pivotally connected to the boot shell to allow the foot to enter the ski boot.

A well-recognized prerequisite of skiing practice is that the skier's ankle and leg be held as rigidly and firmly as possible in the ski boot. This demand is primarily met by the boot fastening arrangement, the constructional and operational characteristics whereof are to be in all cases appropriate to withstand the very violent stress forces to which they are subjected in practicing the sport, and provide, on the other hand, convenient and quick operating features for the user.

Fastening arrangements made available by the most up-to-date prior art generally employ stretching units, variously located on the rear of the bootleg, which act on one or more wire cables interconnecting (for fastening and unfastening) the front and rear parts of the bootleg.

While ensuring a highly satisfactory fastening action, such fastening arrangements generally apply a stress to the bootleg which has an asymmetrical component and may be of considerable magnitude, such that the skier's ankle an undesired torque may be imparted to.

SUMMARY OF THE INVENTION

It is the primary object of this invention to provide a fastening arrangement for ski boots, as indicated, which has such construction and performance features as to obviate the cited drawback with which the prior art is beset.

This and other objects to become apparent from the ensuing description are achieved by a fastening arrangement according to the invention, comprising a lever for tensioning a pull cable, affixed rearwardly to the rear part of a ski boot bootleg, being characterized in that it comprises a plurality of lay pulleys arranged symmetrically at mutually corresponding locations on opposite sides of the front and rear parts of the bootleg, at least one pair of deflector members mounted on opposite sides of the boot shell at symmetrical locations thereof intermediate two lay pulleys on said front part, and in that the pull cable, being run over all said pulleys and said deflector members, has ends attached to said boot shell at symmetrical locations on opposed sides thereof.

BRIEF DESCRIPTION OF THE INVENTION

Figure 1:
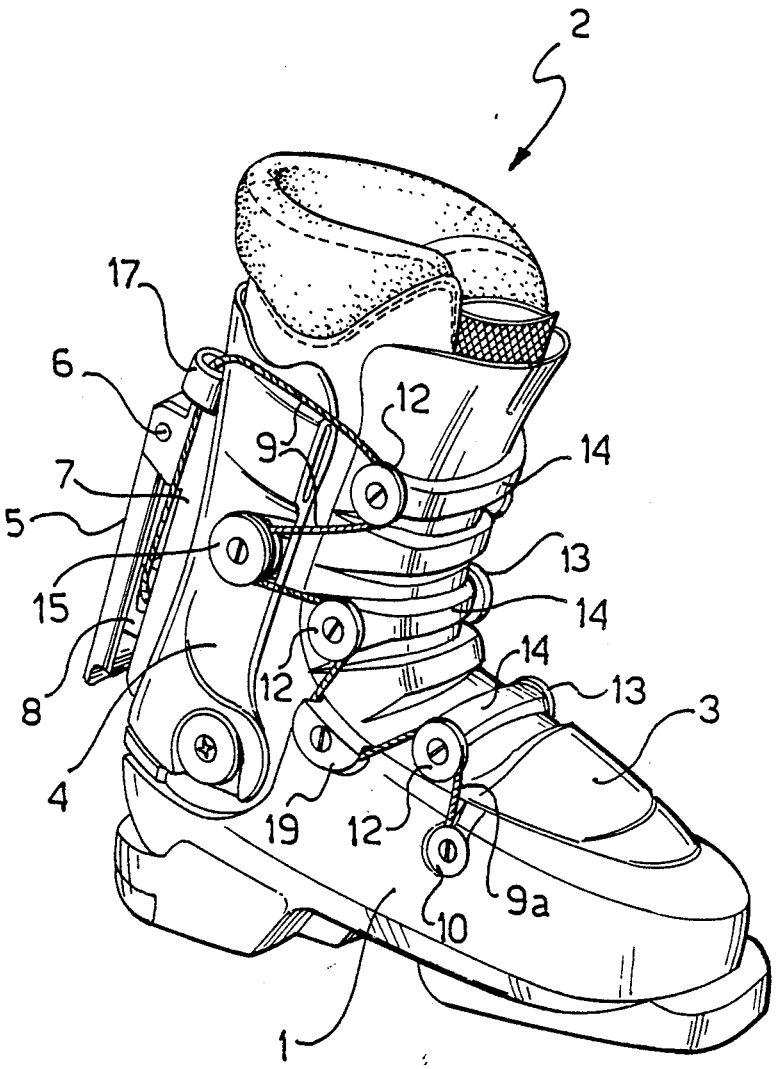
Figure 2:
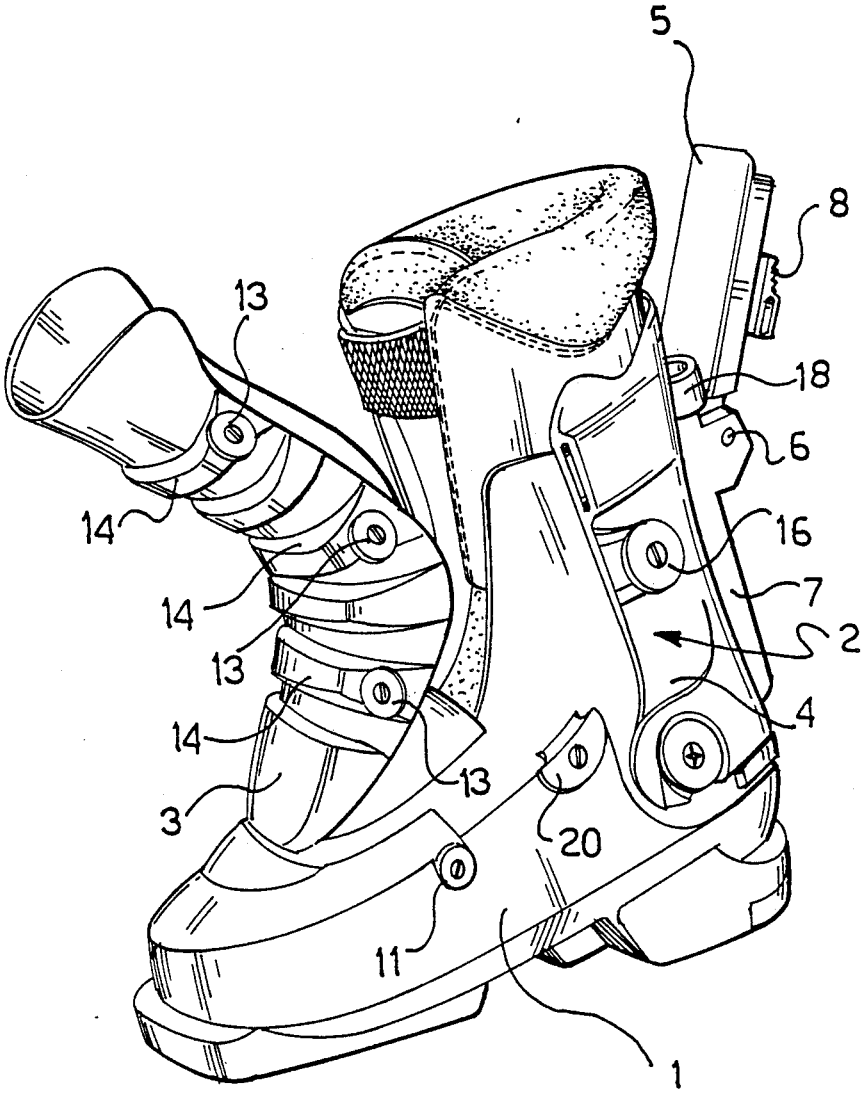

The advantages and features of the invention will be more clearly understood by having reference to the following detailed description of a fastening arrangement for ski boots, to be taken in conjunction with the accompanying illustrative and non-limitative drawings, where:

FIG. 1 shows schematically a perspective view of a ski boot of the rear-fit type, as provided with the fastening arrangement of this invention and in the fastened or closed condition; and FIG. 2 is a perspective view of the same ski boot as shown in FIG. 1, but in the open condition ready to be put on, with the pull cable of the fastening arrangement according to the invention omitted for clarity of illustration.

With reference to the drawing figures, a fastening arrangement according to the invention is shown, by way of example, as applied to a ski boot of the rear-fit type. Such a ski boot is comprised of a shell 1 and a bootleg 2, the latter being essentially defined by a front part 3 and a rear part 4 which are connected pivotally to the boot shell 1 in a manner known per se such that they can be moved away from and toward each other for putting on the boot and securing the skier's foot inside the boot, respectively.

A fastening arrangement according to the invention comprises a tensioning lever 5 pivoted on a pivot pin 6 carried on a small base 7, the latter being attached rearwardly to the rear part 4 of the bootleg 2 at a central location thereon.

Associated with the tensioning lever 5, with the interposition of a tension control member 8, is a thin pull cable 9 having ends **9*a* (9*b*) attached to opposed sides of the boot shell 1, at symmetrical locations 10, 11** thereon.

The fastening arrangement of this invention further comprises a plurality of lay pulleys 12, 13 mounted on respective opposed sides of the front part 3 of the bootleg 2, at symmetrically corresponding locations.

Advantageously, the pairs of corresponding pulleys 12, 13 on said front part 3 are mounted at the ends of respective moldings, collectively designated 14, which are formed on said front part 3 of the bootleg 2 and extend across it.

The rear part 4 of the bootleg 2 is also provided with a pair of lay pulleys 15, 16 mounted at symmetrical locations to correspond with each other. In the vicinity of the base 7, and specifically of the pivot pin 6 carried thereon, the rear part 3 has two cable leaders 17, 18 through which the pull cable is led and allowed to run freely.

At a location intermediate two lay pulleys 12,12 and 13, 13, of the front part 3, there are two cable deflector members 19, 20 attached to the shell 1 which have a semicircular contour shape.

The cable 9 is run over the tension control member 8 on lever 5, the plural lay pulleys 12, 13, 15, 16 and 19, 20 as clearly shown in FIG. 1.

On fastening the bootleg 2, the pull force applied by the lever 5 to the cable 9 is translated into an equal and symmetrical pull exerted on the two opposed sides of the front 3 and deflector members rear 4 parts of said bootleg, which effectively eliminates the likelihood of a torque effect being applied to the ankle and leg of the ski boot user.

In addition, a tight fastening of the bootleg 2 is readily achieved, despite the large pull force developed in a fastening arrangement according to the invention, for a reduced effort by the user by virtue of the plural lay pulleys over which the pull cable 9 is run.

I claim:

1. A fastening arrangement for a ski boot having a front part and a rear part pivotally connected to a boot shell to jointly define a bootleg portion of the ski boot and to allow a foot to enter the ski boot, said fastening arrangement comprising a lever for tensioning a pull cable affixed rearwardly to the rear part of the bootleg, a plurality of lay pulleys arranged symmetrically at mutually corresponding locations on opposite sides of the front and rear parts of the bootleg, at least one pair of deflector members mounted on opposite sides of the boot shell at symmetrical locations thereof intermediate two lay pulleys on said front part, and a pull cable running over said lever, all said pulleys and said deflector members and having ends attached to said boot shell at symmetrical locations on opposite sides thereof.

2. A fastening arrangement according to claim 1, wherein the corresponding lay pulley pairs on said front part of the bootleg are mounted at opposite ends of respective moldings formed on said front part and extending thereacross.

3. A fastening arrangement according to claim 1, further including two cable leaders mounted on said rear part of the bootleg in the vicinity of pivot means for said tensioning lever.

* * * * *